US006420103B1

(12) United States Patent
Honan et al.

(10) Patent No.: US 6,420,103 B1
(45) Date of Patent: Jul. 16, 2002

(54) PHOTOGRAPHIC ELEMENT

(75) Inventors: James S. Honan, Spencerport; Thomas A. Rosiek, Honeoye Falls; Brian Thomas, Pittsford; David D. Miller, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/266,178

(22) Filed: Mar. 10, 1999

(51) Int. Cl.[7] ..... G03C 1/38
(52) U.S. Cl. ..... 430/546
(58) Field of Search ..... 430/546

(56) References Cited

U.S. PATENT DOCUMENTS

| | | | | |
|---|---|---|---|---|
| 2,322,027 A | | 6/1943 | Jelley et al. | 430/546 |
| 2,787,544 A | | 4/1957 | Godowsky et al. | 430/545 |
| 2,801,170 A | | 7/1957 | Vittum et al. | 430/545 |
| 2,801,171 A | | 7/1957 | Fierke et al. | 430/546 |
| 2,949,360 A | | 8/1960 | Julian | 430/546 |
| 3,396,027 A | | 8/1968 | McFall et al. | 430/642 |
| 4,840,878 A | * | 6/1989 | Hirose et al. | 430/546 |
| 4,857,449 A | * | 8/1989 | Ogawa et al. | 430/546 |
| 5,004,675 A | * | 4/1991 | Yoneyama et al. | 430/546 |
| 5,286,616 A | * | 2/1994 | Sakai et al. | 430/546 |
| 5,370,978 A | * | 12/1994 | Takahashi | 430/546 |

FOREIGN PATENT DOCUMENTS

| | | |
|---|---|---|
| EP | 295 583 | 12/1988 |
| GB | 1 436 994 | 5/1976 |

* cited by examiner

*Primary Examiner*—Hoa Van Le
(74) *Attorney, Agent, or Firm*—Andrew J. Anderson

(57) ABSTRACT

Silver halide light sensitive photographic elements are disclosed comprising a support bearing at least one yellow image forming hydrophilic colloid layer comprising a yellow dye-forming coupler and a trialkyl citrate coupler solvent of the formula $C_3H_4(OH)(CO_2R)_3$, where each R independently represents an alkyl group and the total number of carbon atoms for the three R groups combined is greater than 6. The combination of such citrate ester solvents with yellow dye forming couplers in photographic elements leads to both good reactivity and good image-dye light stability. The advantages of the invention are particularly useful for photographic color paper elements on reflective supports.

10 Claims, No Drawings

PHOTOGRAPHIC ELEMENT

FIELD OF THE INVENTION

The present invention relates generally to the field of silver halide light sensitive photographic elements, and in particular to photographic elements having at least one yellow imaging layer comprising a yellow dye forming coupler and an alkyl citrate coupler solvent.

BACKGROUND OF THE INVENTION

Various techniques are known for dispersing hydrophobic photographically useful compounds such as photographic couplers into photographic element layer coating compositions comprising hydrophilic colloids.

Photographic dye forming couplers, as well as other hydrophobic photographically useful compounds, are typically incorporated into a hydrophilic colloid layer of a photographic element by first forming an aqueous dispersion of the couplers and then mixing such dispersion with the layer coating solution. An organic solvent is typically used to dissolve the coupler, and the resulting organic solution is then dispersed in an aqueous medium to form the aqueous dispersion.

The organic phase of these dispersions frequently includes high boiling or permanent organic solvents, either alone or with low boiling or water miscible solvents which are removed after dispersion formation. Permanent high boiling solvents have a boiling point sufficiently high, generally above 100° C. and preferably above 150° C. at atmospheric pressure, such that they are not evaporated under normal dispersion making and photographic layer coating procedures. Permanent high boiling coupler solvents are primarily used in the conventional "oil-protection" dispersion method whereby the organic solvent remains in the dispersion, and thereby is incorporated into the emulsion layer coating solution and ultimately into the photographic element.

The conventional "oil in water" dispersion method for incorporating hydrophobic couplers is described, e.g., in U.S. Pat. No. 2,322,027 by Jelly and Vittum. In such conventional process, the coupler is dissolved in a high boiling water immiscible solvent, mixed with aqueous gelatin, and dispersed using a colloid mill or homogenizer. The presence of the high boiling solvent provides a stable environment for the hydrophobic coupler, as well as generally increasing the reactivity of the coupler upon photographic processing.

A wide variety of organic solvents have been disclosed for use in dispersing photographic couplers and other photographically useful compounds. The choice of solvent or solvents to be used in a specific coupler dispersion formulation is governed by the desire to achieve a proper balance of dispersing properties with photographic performance properties. Dispersing properties include dissolution of the photographic couplers and additional photographic useful materials, dispersability in gelatin to form a fine particle dispersion, stability of the dispersion with respect to growth in particle size and crystallization of the photographic couplers and materials both in cold storage and in a melted state. Photographic properties which can be affected by the coupler solvent choice include the amount of dye formed under certain processing conditions, the hue of the dye, and the stability of the dye image to light, heat and humidity. The cost of the solvent, its effects on the environment, and its physical properties such as boiling point, viscosity, refractive index and the like are also important factors.

In formulating dispersions for yellow image dye-forming couplers, it is particularly important to balance photographic reactivity with dye stability to light, as yellow image dyes in photographic materials typically perform poorer relative to cyan and magenta image dyes with respect to dye image light stability, especially in view of recent advances obtained for magenta dye light stability. Phthalic acid esters such as dibutylphthalate have been found to be effective coupler solvents for yellow image dye-forming couplers, and have been commercially used. Such solvents, however, have been identified as possessing potentially undesirable biological properties. Hence, it is desired to identify alternative solvents to be used with yellow couplers which are more benign in terms of their potential health and environmental effects, but which still provide all the desirable photographic properties.

Citrate esters are a known class of organic solvents which have been suggested for use in photographic elements as in U.S. Pat. No. 5,286,616. Citrate ester solvents may be acetylated or non-acetylated. Non-acetylated citrate ester solvents have a free hydroxyl group, while the acetylated citrate ester solvents replace the hydrogen in the hydroxyl group with an acetyl group, —COOR, where R is an alkyl or aryl substituent.

The selection of an alternative solvent specifically for use with yellow dye forming couplers has required significant exploration and research in order to provide a coupler dispersion which provides desired functionality. It would be desirable to provide a silver halide photographic element which contains a yellow image forming layer comprising a yellow coupler and a coupler solvent which meets such objectives.

SUMMARY OF THE INVENTION

In accordance with one embodiment of the invention, a silver halide light sensitive photographic element is disclosed comprising a support bearing at least one yellow image forming hydrophilic colloid layer comprising a yellow dye-forming coupler and a trialkyl citrate coupler solvent of the formula $C_3H_4(OH)(CO_2R)_3$, where each R independently represents an alkyl group and the total number of carbon atoms for the three R groups combined is greater than 6.

In accordance with a particular embodiment of the invention, a color paper photographic element is disclosed comprising a reflective support bearing cyan, magenta and yellow dye forming silver halide emulsion hydrophilic colloid layer units sensitized to the red, green and blue regions of the spectrum, wherein the yellow dye forming unit comprises at least one layer hydrophilic colloid layer comprising a yellow dye-forming coupler and a trialkyl citrate coupler solvent as described above.

We have found that the combination of such citrate ester solvents with yellow dye forming couplers in photographic elements surprisingly leads to both good reactivity and good image-dye light stability. The advantages of the invention are particularly useful for photographic color paper elements on reflective supports, although they will also be useful for motion picture print film and other projection or display films on transparent or diffuse supports.

DETAILED DESCRIPTION OF THE INVENTION

The photographic elements of the invention comprise at least one yellow image forming hydrophilic colloid layer comprising a yellow image dye forming coupler and a trialkyl citrate coupler solvent of the formula $C_3H_4(OH)(CO_2R)_3$, where each R independently represents an alkyl group and the total number of carbon atoms for the three R groups combined is greater than 6. Citrate ester solvents used in accordance with the invention preferably are of the following formula (I):

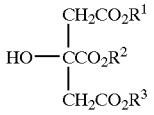

wherein each of $R^1$, $R^2$ and $R^3$ independently represents an alkyl group and the sum of the number of carbon atoms in $R^1$, $R^2$ and $R^3$ combined is at least 7, more preferably at least 9 and less than or equal to 30, and most preferably from 12 to 18. The alkyl groups may be substituted with photographically acceptable substituents which do not substantially detrimentally effect photographic performance. Specific examples of citrate ester solvents for use in accordance with the invention include the following solvents I-1 through I-6, wherein the $R^1$, $R^2$ and $R^3$ groups are indicated in reference to formula (I) above.

| Solvent | $R^1$ | $R^2$ | $R^3$ |
|---|---|---|---|
| I-1 | Butyl | Butyl | Butyl |
| I-2 | Propyl | Propyl | Propyl |
| I-3 | Hexyl | Hexyl | Hexyl |
| I-4 | 2-ethylhexyl | 2-ethylhexyl | 2-ethylhexyl |
| I-5 | Methyl | Ethyl | Butyl |
| I-6 | Ethyl | Ethyl | Propyl |

Particularly preferred solvents include I-1 (tributyl citrate), I-2 (tripentyl citrate), and I-3 (trihexyl citrate).

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

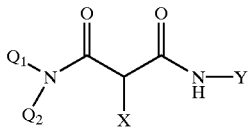

YELLOW-2

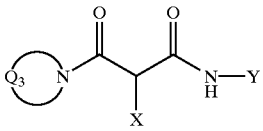

-continued

YELLOW-3

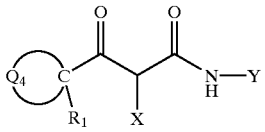

YELLOW-4

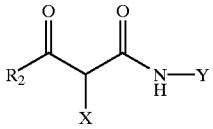

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are acylacetanilide compounds, and especially pivaloylacetanilide compounds represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Representative yellow image dye-forming couplers that can be used in the elements of this invention include those shown below.

Y-1

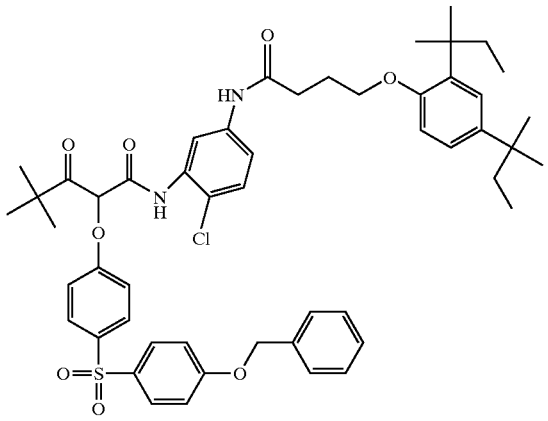

-continued
Y-2
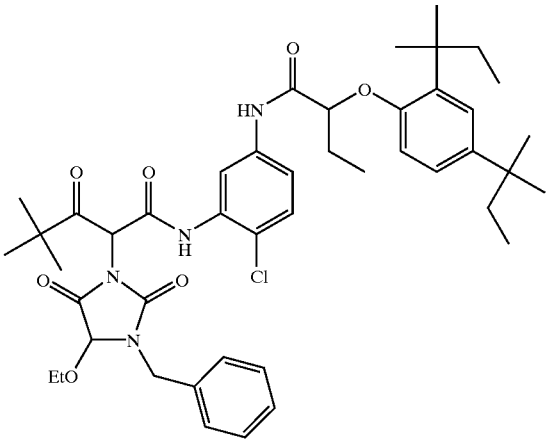
Y-3
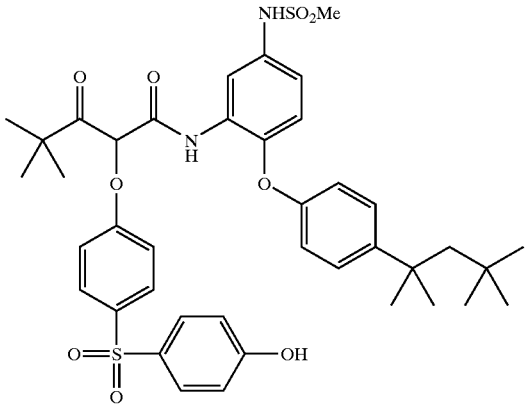
Y-4
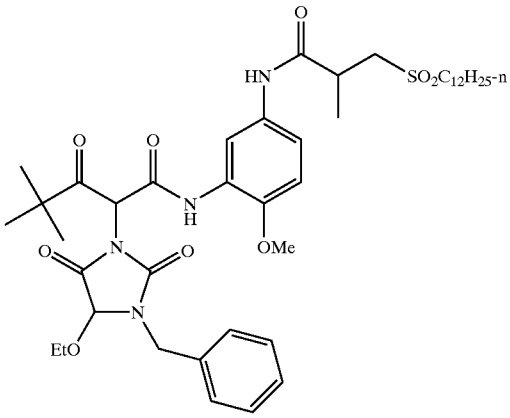
Y-5
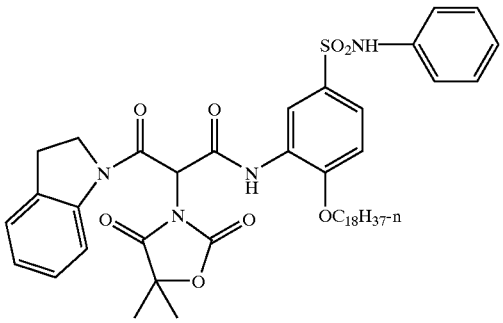
-continued
Y-6
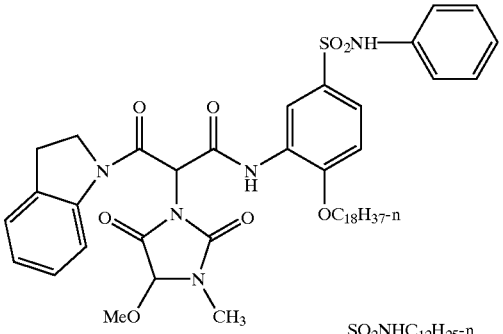
Y-7
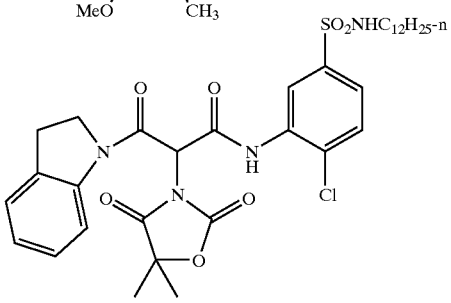
Y-8
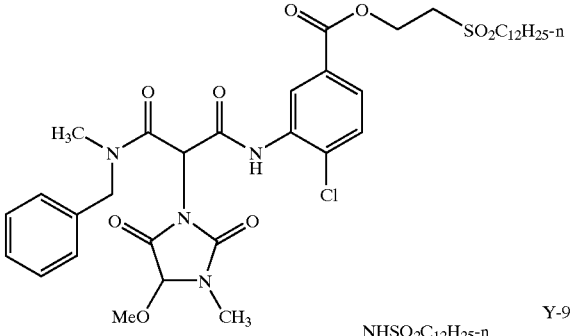
Y-9
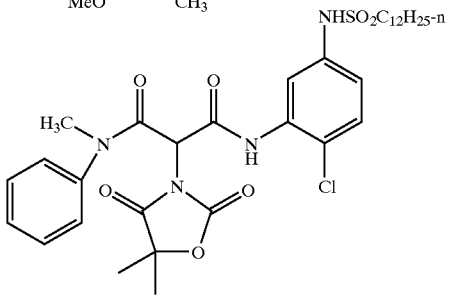
Y-10
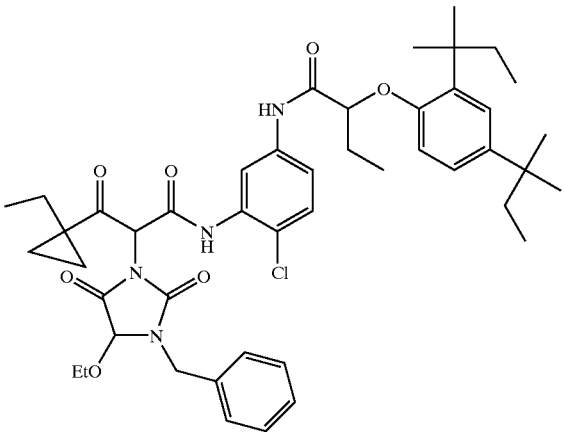

-continued
Y-11
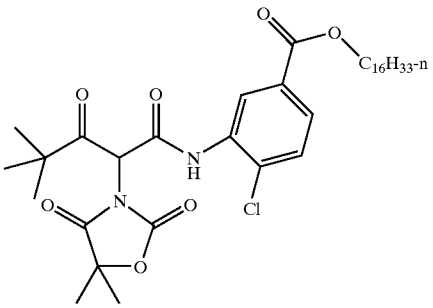
Y-12
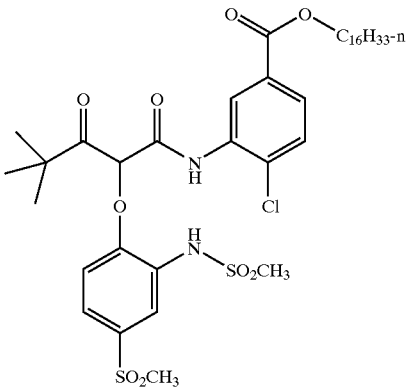
Y-13
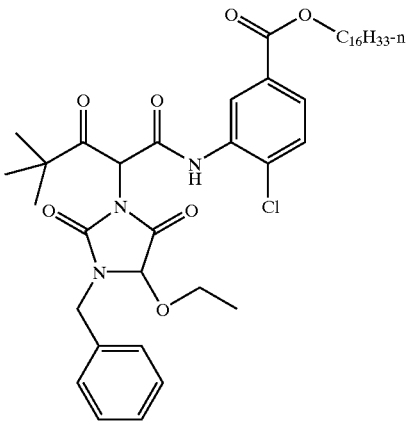
Y-14
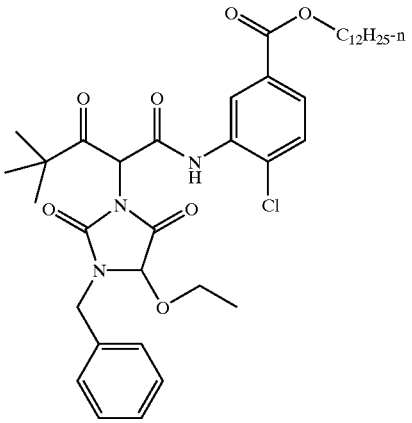
-continued
Y-15
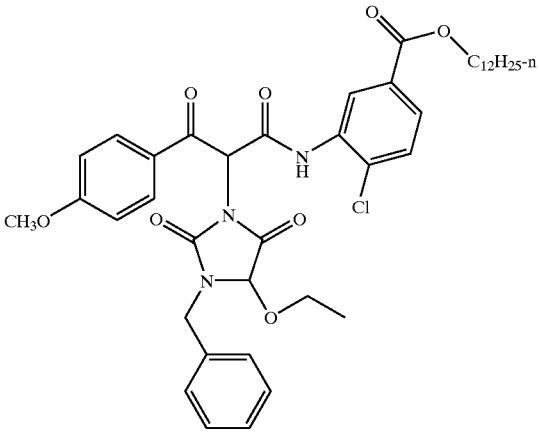
Y-16
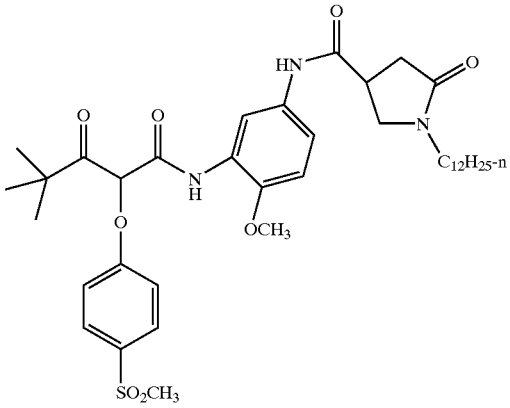
Y-17
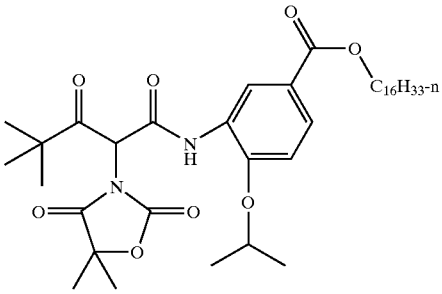
Y-18
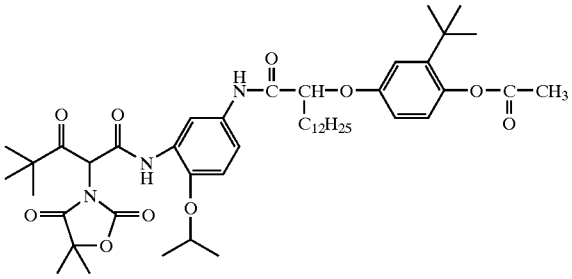
Dispersions of yellow image forming couplers and citrate ester solvents for use in the invention can be prepared by dissolving the couplers in the citrate ester solvent, with or without additional low boiling or partially water soluble auxiliary organic solvents, mixing the resulting liquid organic phase with an aqueous solution of a hydrophilic colloid, and then passing the mixture through a mechanical mixing device suitable for high shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent, if present, may then be removed by evaporation, noodle washing, or membrane dialysis. If not removed prior to coating in a photographic element layer, partially water soluble auxiliary organic solvents may diffuse throughout the hydrophilic colloid layers of the element, and be removed during photographic processing. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027. Preferred weight ratios of citrate ester solvent to yellow coupler in the yellow image forming layer of the photographic elements of the invention are at least about 1:10 and less than about 10:1, more preferably less than about 5:1, and most preferably at least about 1:5 and less than about 2:1.

Examples of suitable auxiliary solvents which may be used in combination with the citrate solvents include: ethyl acetate, isopropyl acetate, butyl acetate, ethyl propionate, 2-ethoxyethylacetate, 2-(2-butoxyethoxy) ethyl acetate, triethylcitrate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents, when present, include ethyl acetate and 2-(2-butoxyethyoxy) ethyl acetate. In accordance with preferred embodiments of the invention, however, auxiliary solvents are not used. It is an advantage of the invention that a good balance of dispersing and photographic properties is obtained even in the absence of such auxiliary solvents, which minimizes environmental impact.

The aqueous phase of the coupler dispersions preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The photographic elements in accordance with preferred embodiments of the invention further comprise at least one cyan image forming hydrophilic colloid layer and at least one magenta image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. Dyes which primarily absorb red light are referred to as cyan dyes, dyes which primarily absorb green light are referred to as magenta dyes and dyes which primarily absorb blue light are referred to as yellow dyes. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. While the invention will be described primarily with reference to a typical color paper format, it will be readily apparent to the artisan that the invention will equally apply to additional photographic element formats. The image dyes will typically be formed during a development step which comprises contacting the element with a basic solution and a paraphenylene diamine development agent to reduce silver halide to silver metal with concomitant production of an oxidized form of color developer. This oxidized color developer in turn reacts with a photographic coupler to form the chromogenic cyan, magenta and yellow dye images, all as known in the art. The couplers may be monomeric or polymeric in nature. The development step may be amplified by the presence of peroxides as known in the art. The photographic element may then be optionally desilvered using any technique known in the art. The element may comprise a reflective support, such as that used in color papers, or a transparent support such as that used in projection display materials. The use of a support comprising a paper base and a layer of microvoided biaxially oriented polyolefin sheet as described in U.S. Pat. No. 5,866,282 is specifically contemplated.

If desired, the photographic element can be used in conjunction with an applied magnetic layer as described in *Research Disclosure*, November 1992, Item 34390. It is also specifically contemplated to use photographic elements according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND. The components, assembly and processing of color photographic materials are described in detail at *Research Disclosure* Item 17643, 1978; Item 18716, 1979; Item 308119, 1989; and Item 36544, 1994, all published by Kenneth Mason Publications, Ltd., the disclosures of which are incorporated by reference. Materials and methods useful in the preparation of color photographic display materials are additionally described at T. H. James, Ed., "The Theory of the Photographic Process," Macmillan, New York, 1977; "The Kirk-Othmer Encyclopedia of Chemical Technology," John Wiley and Sons, New York, 1993; Neblette's "Imaging Processes and Materials," Van Nostrand Reinhold, New York, 1988; and Keller, Ed. "Science and Technology of Photography, VCH, New York, 1993. Materials useful in the preparation of color papers are further illustrated by current commercial practice as, for example, by EDGE™, PORTRA™ or SUPRA™, Color Papers as sold by Eastman Kodak Company, by FUJI™ FA-family Color Papers as sold by Fuji Photo Film, by KONICA™ QA-family Color Papers as sold by Konishiroku Industries, by DURATRANS™ and DURACLEAR™ display films as sold by Eastman Kodak Company and by KONSENSUS-II™ display films as sold by Konishiroku Industries. The advantages of the current invention may be achieved by modifying any of these formulations to conform to the requirements set forth in the specification. The exact magnitude of the benefits achieved will, of course, depend on the exact details of the formulations involved but these will be readily apparent to the skilled practitioner. It is contemplated that photographic elements, and specifically color photographic paper elements, according to the present invention will further comprise ultraviolet absorber dyes and soluble dyes removed during processing, all as known in the art.

Image dyes formed in photographic print elements designed for direct or projection viewing generally have been found to be far more susceptible to degradation due to light exposures than dyes formed in camera negative films, which are typically stored in dark conditions. Accordingly, the photographic elements of the invention in accordance with particular embodiments of the invention preferably comprise photographic print elements. Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers when rated using the same international standards criteria used for rating camera negative films, would typically have an ISO speed rating of less than 10, which is several stops slower than the slowest camera negative films in current use.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The preferred silver halide emulsions employed in the photographic elements of the invention are negative working. Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically less than 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films and papers are intended to be exposed by a controlled light source, the imaging speed gain which would be associated with high bromide emulsions and/or iodide incorporation offers little benefit for such print elements.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

The yellow, cyan and magenta dye forming couplers that may be used in the elements of the invention can be defined as being 4-equivalent or 2-equivalent depending on the the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

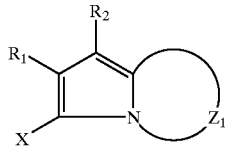

CYAN-2

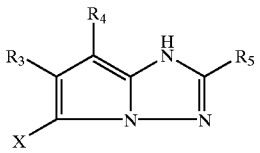

-continued

CYAN-3

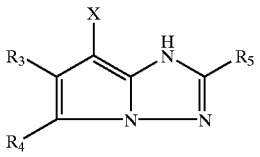

CYAN-4

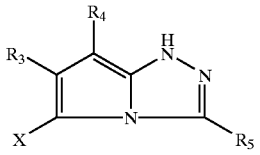

CYAN-5

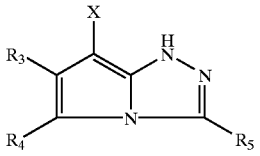

CYAN-6

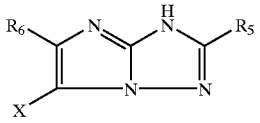

wherein $R_1$ and $R_5$ each represent a hydrogen or a substituent; $R_2$ represents a substituent; $R_3$ and $R_4$ each represent an electron attractive group having a Hammett's substituent constant spara of 0.2 or more and the sum of the spara values of $R_3$ and $R_4$ is 0.65 or more; $R_6$ represents an electron attractive group having a Hammett's substituent constant spara of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

More preferable are cyan couplers of the following formulas:

CYAN-7

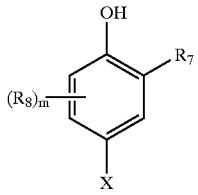

-continued

CYAN-8

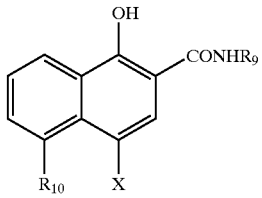

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonarnido group); X represents a hydrogen or a coupling-off group; and m is from 1–3. Couplers of the structure CYAN-7 are most preferable for use in elements of the invention.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

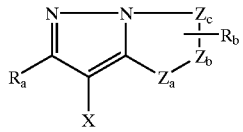

MAGENTA-2

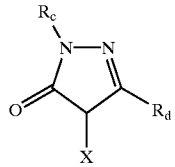

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$. Use of yellow image forming layers in accordance with the invention may be particularly useful in combination with magenta image forming layers comprising pyrazoloazole dye forming couplers of formula MAGENTA-1 to provide improved color reproduction performance.

Typical cyan and magenta couplers that can be used in the elements of this invention include those shown below.

C-1

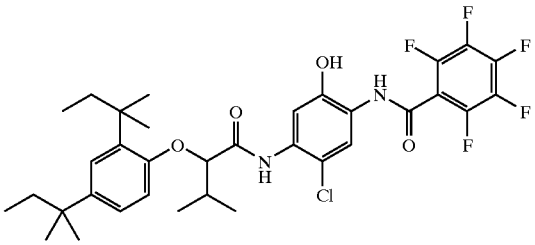

C-2

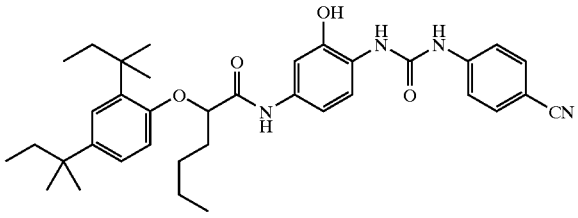

C-3

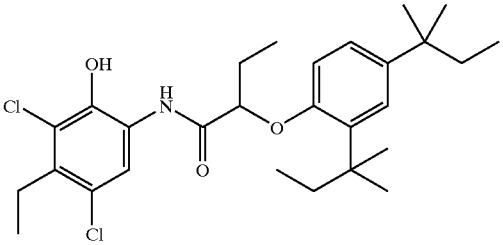

C-4

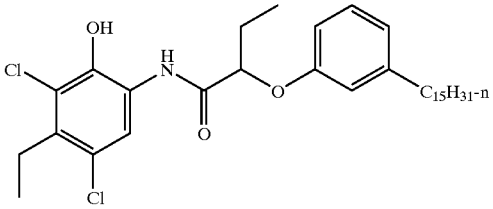

-continued
C-5
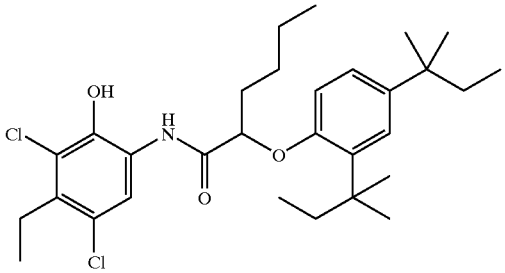
C-6
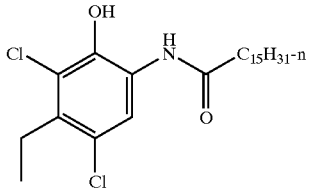
C-7
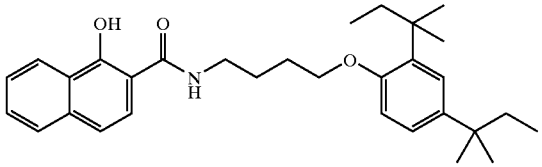
C-8
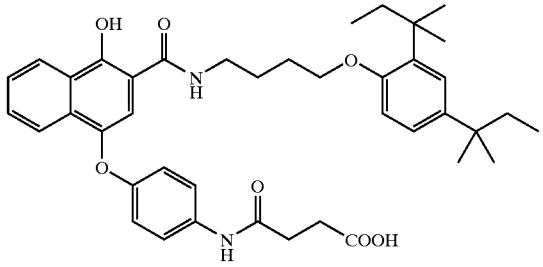
C-9
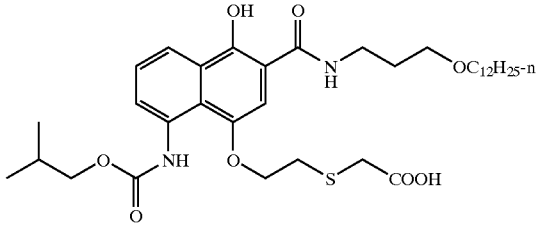
C-10
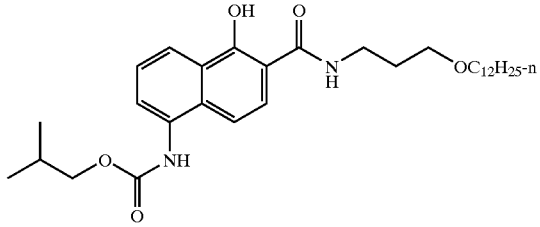
C-11
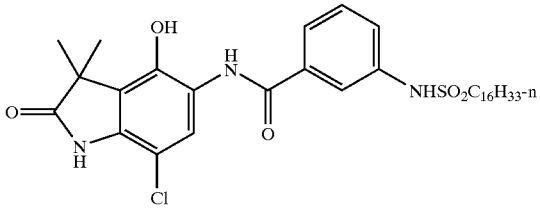
C-12
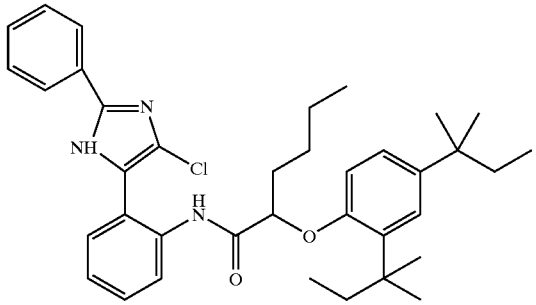
C-13
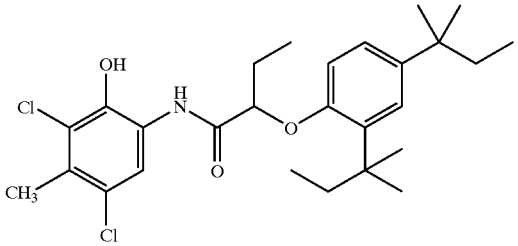
C-14
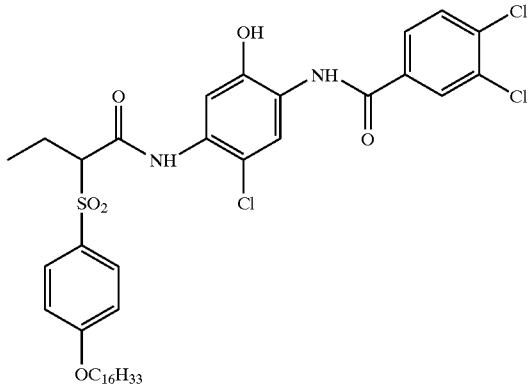

-continued
C-15
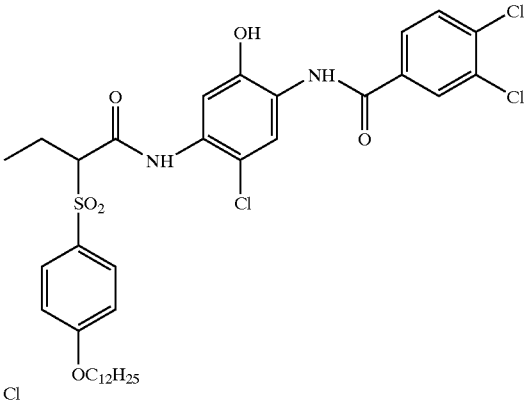
C-16
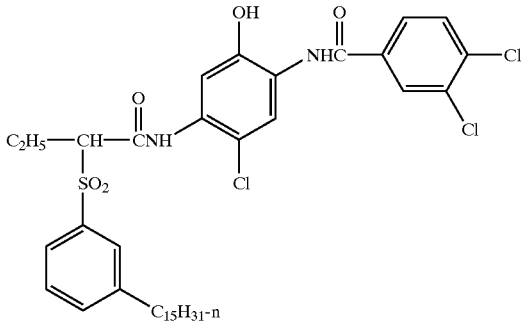
M-1
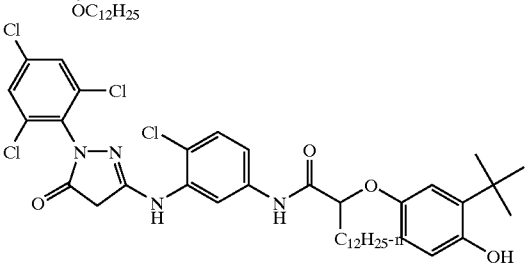
M-2
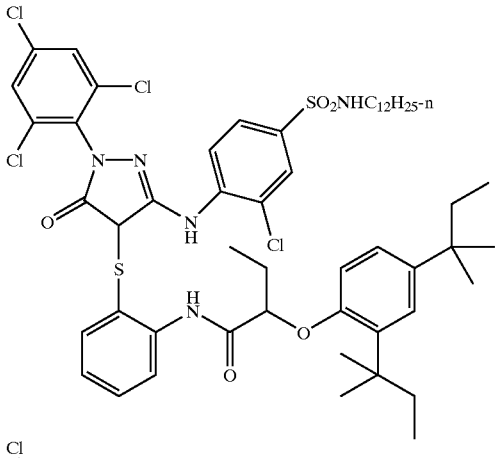
M-3
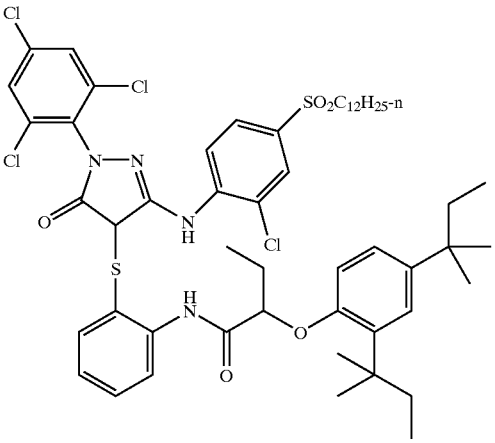
M-4
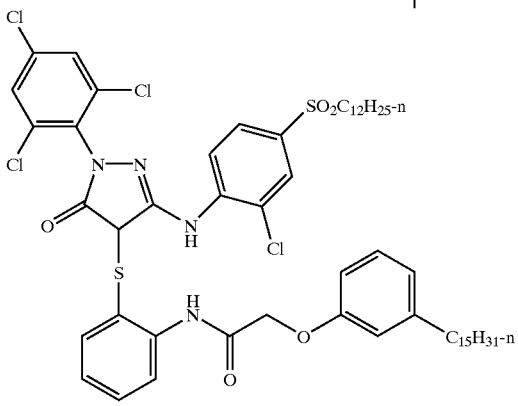
M-5
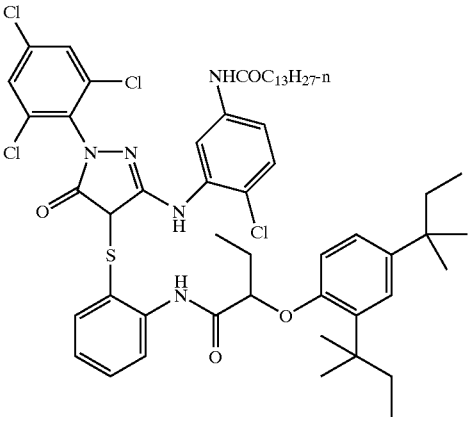
M-6
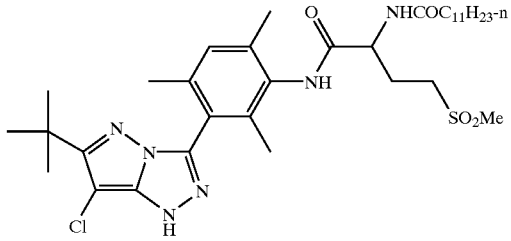

-continued

M-7

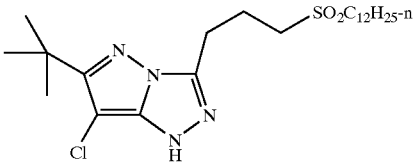

M-8

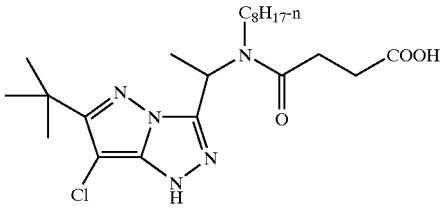

M-9

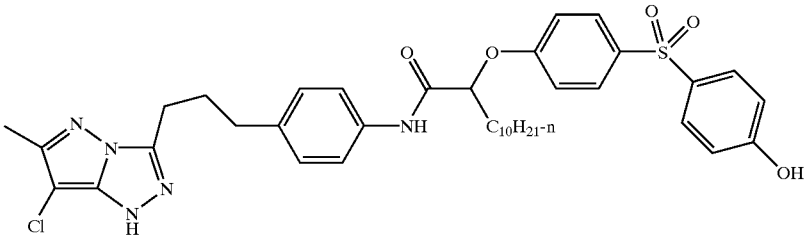

M-10

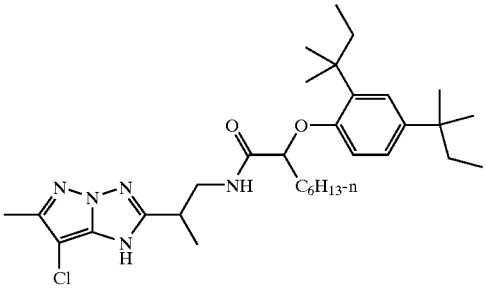

M-11

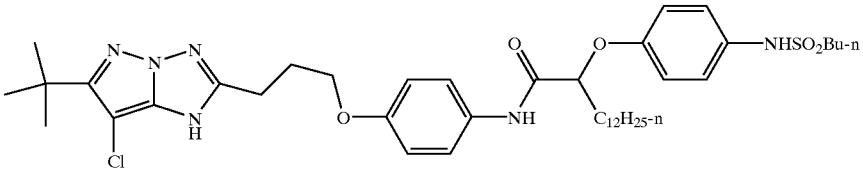

M-12

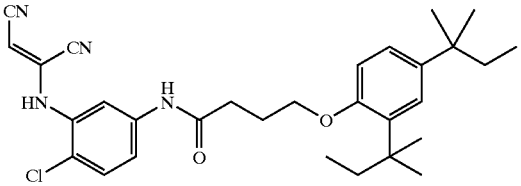

M-13

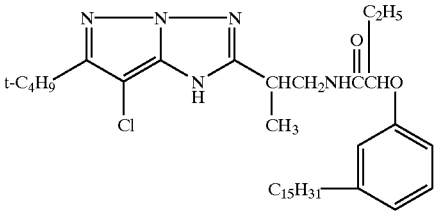

M-14

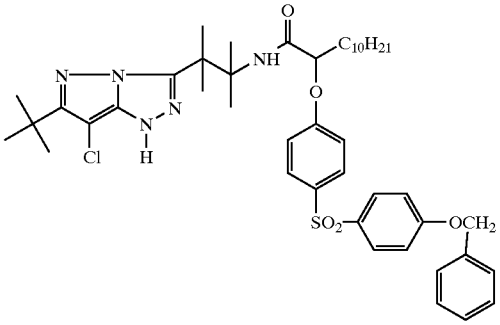

M-15

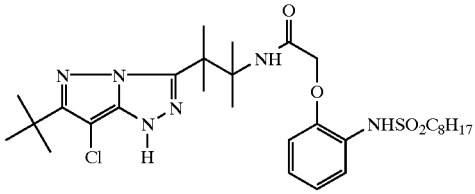

Typical examples of photographic substituents which may be included in the yellow, cyan and magenta couplers which may be used in the elements of the invention include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It may be useful to use a combination of couplers any of which may contain known ballasts or coupling-off groups such as those described in U.S. Pat. Nos. 4,301,235; 4,853,319 and 4,351,897. Additionally, the elements may comprise a substituted pyrazolotriazole or a substituted 3-aminopyrazolone magenta dye-forming image coupler which may be a four equivalent coupler but is preferably a two equivalent coupler. The couplers and coupler mixtures described at U.S. Pat. Nos. 5,091,297; 5,270,153; 4,675,280; 4,755,455; 4,954,431; 5,110,718; 5,084,375; 4,600,688; 4,443,536; and 4,830,955 are additionally useful in the practice of this invention.

To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming dispersion of this invention in combination with a highly-stable pyrazolotriazole magenta dye-forming coupler dispersion.

It is further specifically contemplated to include water insoluble polymers in the image dye forming layers of the elements in accordance with the invention. Polymer containing dispersions of photographic couplers have been employed in photographic materials, as described, e.g., in U.S. Pat. Nos. 3,619,195; 4,203,716; 4,840,885; 4,857,449; 4,939,077; 5,001,045; 5,047,314; 5,055,386; 5,200,304; 5,242,788; 5,294,527; 5,558,980; 5,594,047. A main advantage of polymer-containing dispersions described in the prior art relates to image preservability to heat and light. In accordance with a particular embodiment of the invention, the yellow image forming layer of a photographic element may preferably include a polymer which is formed from at least 30 wt % monomer units which provide the polymer with functional groups that are hydrogen bond donors, as such polymers have been found to provide improved light stability, especially for yellow couplers. In accordance with a further specific embodiment, it may be preferable to include a polymer which has a glass transition temperature of less than 75° C. and is formed from at least 30 wt % monomer units which provide the polymer with functional groups that are hydrogen bond donors as described in copending, commonly assigned U.S. Ser. No. 08/997,494, now U.S. Pat. No. 5,481,159, the disclosure of which is incorporated by reference herein. A particularly preferred polymer formulation is a 50:50 by weight copolymer of t-butylacrylamide and n-butylacrylate. Such polymers may be conveniently incorporated in image forming layers in the form of latex dispersions.

Various types of hardeners are useful in conjunction with elements of the invention. In particular, bis(vinylsulfonyl) methane, bis(vinylsulfonyl) methyl ether, 1,2-bis (vinylsulfonyl-acetamido) ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

The invention may also be used in combination with photographic elements containing filter dye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556 and 4,543,323.)

It is specifically contemplated that the concepts of the present invention may be employed to obtain reflection color prints as described in *Research Disclosure*, November 1979, Item 18716, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171.

The emulsions can be surface-sensitive emulsions, i.e., emulsions that form latent images primarily on the surfaces of the silver halide grains, or the emulsions can form internal latent images predominantly in the interior of the silver halide grains. Further, the emulsions that can be used in conjunction with elements of the invention are usually negative-working emulsions. Further, it would be advantageous to use the invention in conjunction with emulsions which give a preferred tone scale as described in U.S. Pat. Nos. 5,418,118 and 5,512,103.

Due to a desire for rapid development, preferred emulsions for color paper are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development application process whereby the incorporated silver is used only to form the latent image, while another oxidant, such as hydrogen peroxide, serves as the primary oxidant to react with the color developer. Such processes are well-known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Red-, green- and blue-sensitive emulsions for use in the elements of the invention can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and EP Patent Application 93/203193.3, in conjunction with elements of the invention. Polymer containing yellow dye-forming coupler dispersions in accordance with one embodiment of the invention may be advantageously used in combination with short blue sensitization to enable improved color reproduction in photographic display materials as described in U.S. Pat. No. 5,582,960.

The invention materials may also be used in association with nucleating agents, development accelerators or their precursors (UK Patent 2,097,140; U.K. Patent 2,131,188); electron transfer agents (U.S. Pat. Nos. 4,859,578 and 4,912,025); antifogging and anticolor-mixing agents such as derivatives of hydroquinones, aminophenols, amines, gallic acid; catechol; ascorbic acid; hydrazides; sulfonamidophenols; and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-delta,delta,delta',delta'-tetramethyl-, dihexyl ester; 1,4-Benzenedipentanoic acid, 2-hydroxy-5-methoxy-delta,delta,delta',delta'-tetramethyl-, dihexyl ester; and 2,5-dimethoxy-delta,delta,delta',delta'-tetramethyl-, dihexyl ester.

Various additional image stabilizers that improve image preservability may be used in conjunction with the elements of this invention. Such stabilizers can include any described in the art, including epoxides, sulfinates, hydroxylamines, hindered phenols, bisphenols, electron-rich aromatic compounds, and other polymers.

Various kinds of conventional discoloration inhibitors can also be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat. Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydroxychromans, 5-hydroxycoumarans, spirochromans are disclosed in U.S. Pat. Nos. 3,432,300; 3,573,050; 3,574,627; 3,698,909 and 3,764,337; and Japanese Published Patent Application 52-152,225; and so on; spiroindanes are disclosed in U.S. Pat. No. 4,360,589; those of p-alkoxyphenols are disclosed in U.S. Pat. No. 2,735,765; British Patent 2,066,975; Japanese Published Patent Applications 59-010,539 and 57-019,765; and so on; hindered phenols are disclosed, for example, in U.S. Pat. Nos. 3,700,455; 4,228,235; Japanese Published Patent Applications 52-072,224 and 52-006,623; and so on; gallic acid derivatives, methylenedioxybenzenes and arninophenols are disclosed in U.S. Pat. Nos. 3,457,079; 4,332,886; and Japanese Published Patent Application 56-021,144, respectively; hindered amines are disclosed in U.S. Pat. Nos. 3,336,135; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat. Nos. 4,155,765; 4,174,220; 4,254,216; 4,279,990; Japanese Published Patent Applications 54-145,530; 55-006,321; 58-105,147; 59-010,539; 57-037,856; 53-003,263 and so on; and those of metal complexes are disclosed in U.S. Pat. Nos. 4,050,938 and 4,241,155.

Stabilizers that can be used with the invention include but are not limited to the following.

ST-1

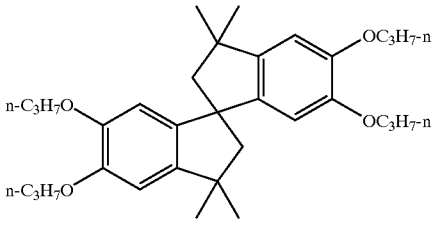

ST-2

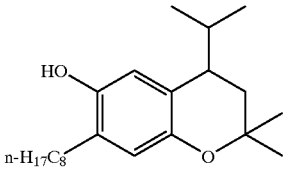

-continued
ST-3
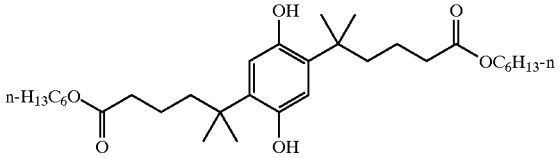
ST-4
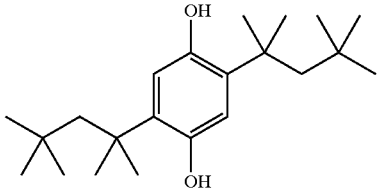
ST-5
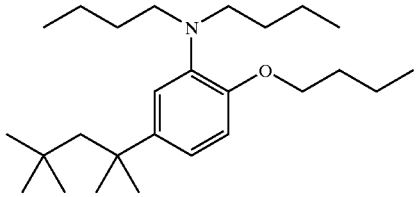
ST-6
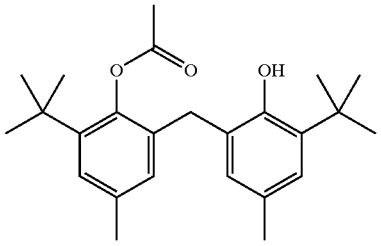
ST-7
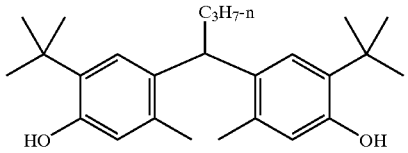
ST-8
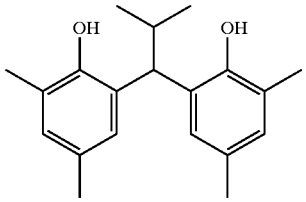
ST-9
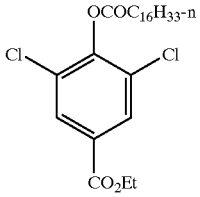
ST-10
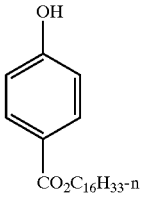
ST-11
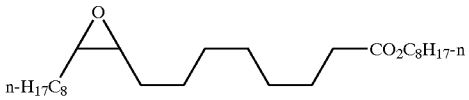
ST-12
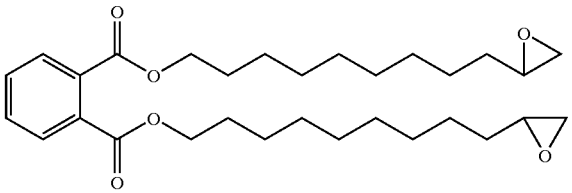
ST-13
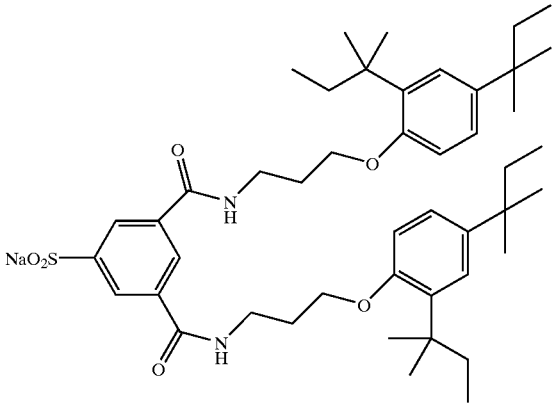
ST-14
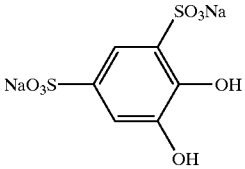

-continued

ST-15

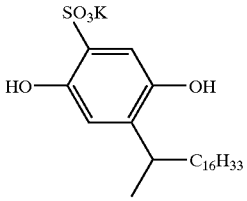

ST-16

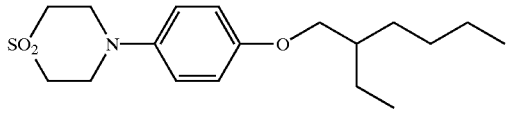

ST-17

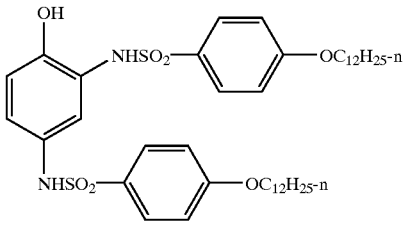

ST-18

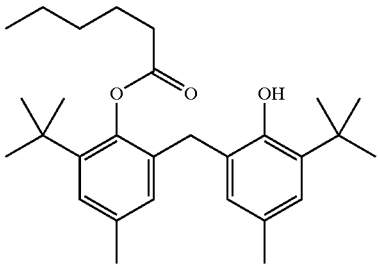

ST-19

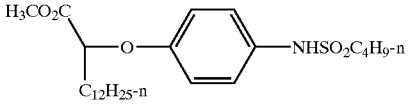

ST-20

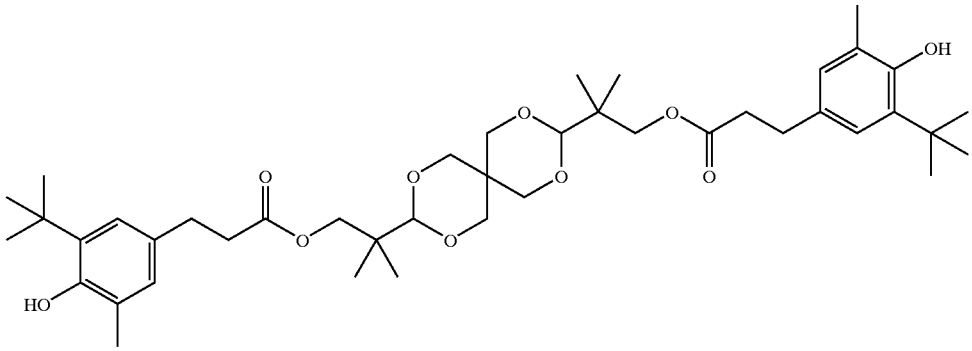

ST-21

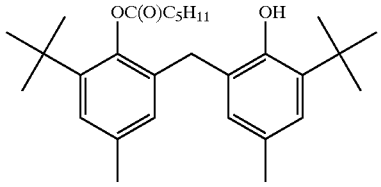

The photographic elements of the invention are further anticipated to include UV stabilizers in preferred embodiments. The UV stabilizers may be soluble polymers, polymer latexes, and dispersed compounds. In addition, it is contemplated that materials of this invention may be used with so-called liquid ultraviolet absorbers such as described in U.S. Pat. Nos. 4,992,358; 4,975,360; and 4,587,346. Examples of typical dispersed UV stabilizers are shown below.

UV-1

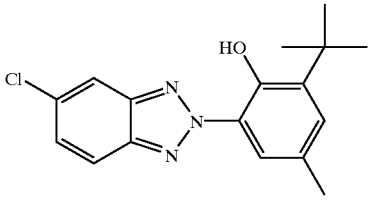

-continued

UV-2

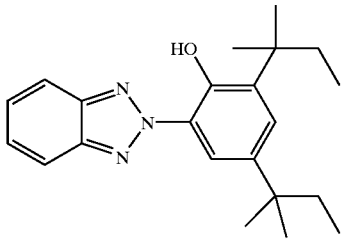

UV-3

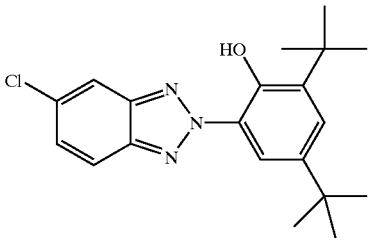

UV-4

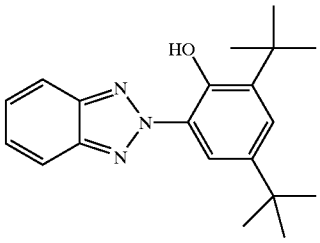

UV-5

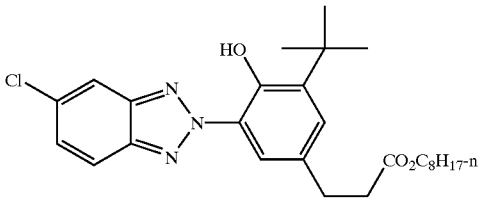

UV-6

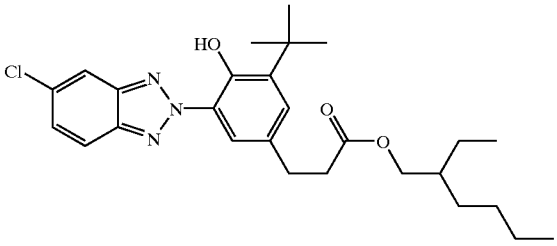

UV-7

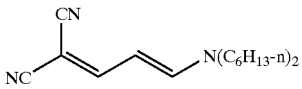

UV-8

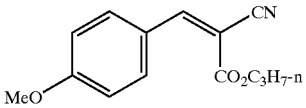

The dispersions and coated layers of the elements of the invention may include surfactants. Surfactants may be cationic, anionic, zwitterionic or non-ionic. Ratios of surfactant to liquid organic solution typically are in the range of 0.5 to 25 wt. % for forming small particle photographic dispersions, which ratios are also useful for forming the invention dispersions. Useful surfactants include, but are not limited to the following.

F-1

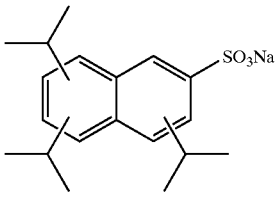

F-2

$CF_3(CF_2)_7SO_3Na$

F-3

$CH_3(CH_2)_nSO_3Na$, n = 12–14

F-4

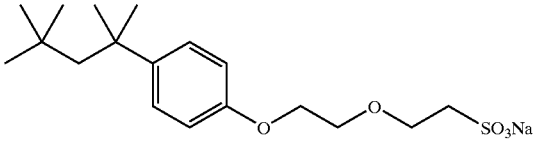

F-5

$CH_3(CH_2)_{11}OSO_3Na$

F-6

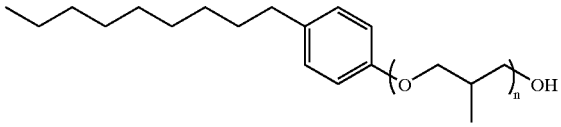

n = ca. 10

F-7

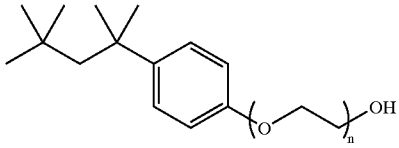

n = ca. 40

F-8

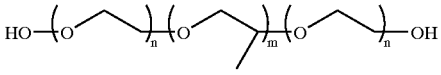

n = ca. 6, m = ca. 22

F-9

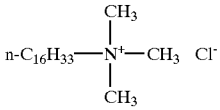

F-10

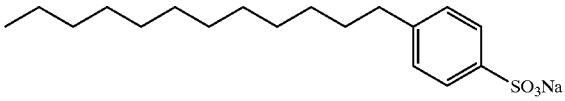

F-11

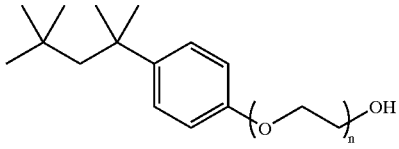

n = ca. 10

F-12

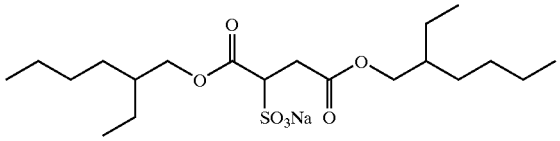

Photographic elements of the invention can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. Protective overcoats may be applied to photographic elements in accordance with the invention as described, e.g., in U.S. Pat. Nos. 5,804,341, 5,853,926 and 5,856,051.

With negative-working silver halide, the processing step described above provides a negative image. It is specifically anticipated that the elements of the invention may be processed in accordance with color print processes, such as the RA-4 process of Eastman Kodak Company as described in the *British Journal of Photography Annual* of 1988, pages 198–199.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. Nos. 5,179,404; EP 559,025; U.S. Pat. No. 5,270,762; EP 559,026; U.S. Pat. No. 5,313,243; U.S. Pat. No. 5,339,131.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, and p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element: 4-amino-3-methyl-N-ethyl-N-(beta-hydroxyethyl) aniline sulfate; 4-amino-3-methyl-N-ethyl-N-(beta-(methanesulfonamidoethyl)aniline sesquisulfate hydrate; 4-amino-N,N-diethylaniline hydrochloride; 4-amino-3-methyl-N,N-diethylaniline hydrochloride; 4-amino-3-beta-(methanesulfonamido)ethyl-N,N-diethylaniline hydrochloride and 4-amino-N-ethyl-N-(2-methoxyethyl)-m-toluidine di-p-toluene sulfonic acid.

Of these, particularly preferred is the use of 4-amino-3-methyl-N-ethyl-N-(beta-(methane sulfonamidoethyl)aniline sesquisulfate hydrate, in conjunction with color paper photographic elements of the invention.

The invention is further described in the following examples.

EXAMPLE 1

Dispersion 1-1 was prepared by combining a solution of 53.9 g of Coupler Y-17, 16.5 g of stabilizer ST-6, 5.5 g of stabilizer ST-18, and 22.1 g of diundecyl phthalate (solvent S-1) at 130° C. with an 80° C. solution consisting of 36.0 g decalcified gelatin, 254.5 g de-mineralized water, 7.5 g 2N propionic acid, and 100.0 g of a 10% solution of surfactant Alkanol XC (trademark of E.I. Dupont Co.). This combined solution was mixed for one minute at 8000 rpm using a Brinkmann rotor-stator mixer, then homogenized via 2 passes through a Microfluidics Microfluidizer at 8000 psi, 80° C. to produce Dispersion 1-1. This dispersion was then placed in cold storage until ready for combination with a light-sensitive photographic emulsion in a photographic element.

Dispersion 1-2 was prepared as Dispersion 1-1, except replacing solvent S-1 with acetyl tributyl citrate (solvent S-2).

Dispersion 1-3 was prepared as Dispersion 1-1, except replacing solvent S-1 with acetyl trihexyl citrate (solvent S-3).

Dispersion 1-4 was prepared as Dispersion 1-1, except replacing solvent S-1 with triethyl citrate (solvent S-4).

Dispersion 1-5 was prepared as Dispersion 1-1, except replacing solvent S-15 with tributyl citrate (solvent I-1).

Dispersion 1-6 was prepared by combining a solution of 36.1 g of Coupler Y-17, 10.8 g of stabilizer ST-6, 3.6 g of stabilizer ST-18, and 18.1 g of diundecyl phthalate (solvent S-1) at 130° C. with an 80° C. solution consisting of 28.0 g decalcified gelatin, 178.2 g de-mineralized water, 5.3 g 2N propionic acid, and 70.0 g of a 10% solution of surfactant Alkanol XC (trademark of E.I. Dupont Co.). This combined solution was mixed for one minute at 8000 rpm using a Brinkinann rotor-stator mixer, then homogenized via 2 passes through a Microfluidics Microfluidizer at 8000 psi, 80° C. to produce Dispersion 1-6. This dispersion was then placed in cold storage until ready for combination with a light-sensitive photographic emulsion in a photographic element.

Dispersion 1-7 was prepared as Dispersion 1-6, except replacing solvent S-1 with acetyl trihexyl citrate (solvent S-3).

Dispersion 1-8 was prepared as Dispersion 1-6, except replacing solvent S-1 with trihexyl citrate (solvent I-3).

Dispersion 1-9 was prepared by combining a solution of 7.8 g of Coupler Y-17, 3.66 g of stabilizer ST-20, 3.9 g of dibutyl phthalate (solvent S-5) at 135° C. with a 70° C. solution consisting of 7.8 g decalcified gelatin, 86 g demineralized water, and 7.8 g of a 10% solution of surfactant Alkanol XC (trademark of E.I. Dupont Co.). This combined solution was mixed for one minute at 8000 rpm using a Brinkmann rotor-stator mixer, 13 g of a 30% solids latex of a 50/50 weight ratio N-tert-butylacrylamide/n-butyl acrylate copolymer (polymer P-1) as added, and the resulting mixture was then homogenized via 2 passes through a Microfluidics Microfluidizer at 8000 psi, 70° C. to produce Dispersion 1-9. This dispersion was then placed in cold storage until ready for combination with a light-sensitive photographic emulsion in a photographic element.

Dispersion 1-10 was prepared as Dispersion 1-9, except replacing solvent S-5 with 2-(2-Butoxyethoxy)ethyl acetate (solvent S-6).

Coating Evaluation

Photographic elements 101 through 105 were prepared using Dispersions 1-1 through 1-5, respectively, by coating the following layers on a gel-subbed, polyethylene-coated paper support:

First Layer

An underlayer containing 3.23 grams gelatin per square meter.

Second Layer

A photosensitive layer containing (per square meter) 1.529 grams gelatin, an amount of blue-sensitized silver chloride emulsion containing the silver necessary to coat 0.258 grams per square meter of silver, and an amount of dispersion necessary to coat 0.592 grams per square meter of coupler Y-17.

Third Layer

A layer containing 1.40 grams gelatin per square meter, 0.549 grams per square meter UV-2 and 0.097 grams per square meter UV-1.

Fourth Layer

A protective layer containing (per square meter) 1.08 grams gelatin, 0.127 grams bis(vinylsulfonyl)methane ether, 8.83 milligrams Alkanol XC, and 3.34 milligrams tetraethylammonium perfluorooctanesulfonate.

Elements 106 through 108 were prepared using Dispersions 1-6 through 1-8 similarly as elements 101–105, except 0.567 grams per square meter of coupler Y-17 were coated in the second layer.

Elements 109 and 110 were prepared using Dispersions 1-9 and 1-10 similarly as elements 101–105, except the second layer contained (per square meter) 1.668 grams gelatin, an amount of blue-sensitized silver chloride emulsion containing the silver necessary to coat 0.269 grams per square meter of silver, and an amount of dispersion necessary to coat 0.538 grams per square meter of coupler Y-17. The third layer contained 0.641 grams per square meter UV-2 and 0.113 grams per square meter UV-1.

Preparation of Processed Photographic Examples

Processed samples were prepared by exposing the coatings through a step wedge and processing in standard RA-4 chemistry, described in the British Journal of Photography Annual of 1988, pp 198–199.

The Status A yellow densities of the processed strips were read and sensitometric curves (density vs log exposure) were generated. The contrast (γ) was measured by calculating the slope of the density vs log exposure plot over the range of 0.6 log E centered on the exposure yielding 1.0 density. This value is reported in Table 1. The light stability of the formed yellow image dyes was measured for each strip after three, four, or five weeks of simulated high intensity daylight (HID) exposure (Xenon arc lamp at an intensity of 50 Klux). The amount of density loss from 1.0 density is reported in Table 1.

| Element/ Dispersion | Y-17 mg/m$^2$ | Sol-vent | Solvent mg/m$^2$ | γ | HID Exposure Density change from 1.0 3 week | 4 week | 5 week |
|---|---|---|---|---|---|---|---|
| 101/1-1 | 592 | S-1 | 242 | 2.55 | −0.117 | | −0.248 |
| 102/1-2 | 592 | S-2 | 242 | 2.59 | −0.111 | | −0.245 |
| 103/1-3 | 592 | S-3 | 242 | 2.59 | −0.109 | | −0.239 |
| 104/1-4 | 592 | S-4 | 242 | 2.37 | −0.114 | | −0.254 |
| 105/1-5 | 592 | I-1 | 242 | 2.67 | −0.098 | | −0.225 |
| 106/1-6 | 567 | S-1 | 283 | 2.55 | −0.130 | | −0.274 |
| 107/1-7 | 567 | S-3 | 283 | 2.62 | −0.124 | | −0.247 |
| 108/1-8 | 567 | I-3 | 283 | 2.68 | −0.119 | | −0.251 |
| 109/1-9 | 538 | S-5 | 269 | 2.46 | −0.105 | −0.168 | |
| 110/1-10 | 538 | S-6 | 269 | 2.36 | −0.082 | −0.135 | |

Elements 105 prepared with solvent I-1 of the invention provides higher contrast and improved light stability compared to use of the phthalate solvent S-1 and the acetylated citrate solvents S-2 and S-3, as in elements 101 through 103. Element 104 is prepared with a non-acetylated citrate solvent with the total number of carbons in the alkyl groups equal to six, and exhibits low contrast. Elements 106 and 107 compare use of phthalate solvent S-1 and acetylated citrate solvent S-3 with solvent I-3 in element 108, the latter having a higher contrast and comparable light stability. Element 109 prepared with dibutyl phthalate and a polymer latex and Element 110 prepared with a partially water soluble solvent S-6 exhibit good light stability, but lower contrast.

EXAMPLE 2

Dispersion 2-1 was prepared by combining a solution of 55.7 g of Coupler Y-11 and 25.1 g of 2-(2-Butoxyethoxy) ethyl acetate (solvent S-6) at 110° C. with an 80° C. solution consisting of 60.0 g decalcified gelatin, 429.9 g de-mineralized water, 5.9 g 2N propionic acid, and 25.7 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 8000 psi, 65° C. to produce Dispersion 2-1. This dispersion was then placed in cold storage until ready for combination with a light-sensitive photographic emulsion in a photographic element.

Dispersion 2-2 was prepared as Dispersion 2-1, except replacing solvent S-6 with tributyl citrate (solvent I-1).

Dispersion 2-3 was prepared similarly to Dispersion 2-1, with solvent S-6 being replaced by dibutyl phthalate (solvent S-5).

Multilayer photographic elements 201–203 were prepared with the following formulations, using Dispersions 2-1 through 2-3 in Layer 1.

| LAYER | COMPONENT | AMOUNT (g/m$^2$) Element 201 | Element 202 | Element 203 |
|---|---|---|---|---|
| 7 | Polydimethylsiloxane | 0.02 | 0.02 | 0.02 |
| | F-1 | 0.008 | 0.008 | 0.008 |
| | F-2 | 0.003 | 0.003 | 0.003 |
| | F-12 | 0.004 | 0.004 | 0.004 |
| | Dye-1 | 0.012 | 0.012 | 0.012 |
| | Dye-2 | 0.006 | 0.006 | 0.006 |
| | Dye-3 | 0.018 | 0.018 | 0.018 |
| | Ludox ™ Colloidal silica | 0.161 | 0.161 | 0.161 |
| | Gelatin (acid-processed ossien) | 0.646 | 0.646 | 0.646 |
| 6 | UV-1 | 0.023 | 0.023 | 0.023 |
| | UV-2 | 0.130 | 0.130 | 0.130 |
| | ST-4 | 0.067 | 0.067 | 0.067 |
| | Dibutyl phthalate | 0.025 | 0.025 | 0.025 |
| | 1,4-Cyclohexylenedimethylene bis(2-ethylhexanoate) | 0.025 | 0.025 | 0.025 |
| | Gelatin | 0.512 | 0.512 | 0.512 |
| 5 | AG-3 Red sensitive Emulsion | 0.185 (g Ag/m$^2$) | 0.185 (g Ag/m$^2$) | 0.185 (g Ag/m$^2$) |
| | C-3 | 0.423 | 0.423 | 0.423 |
| | UV-2 | 0.272 | 0.272 | 0.272 |
| | Dibutyl phthalate | 0.415 | 0.415 | 0.415 |
| | 2-(2-Butoxyethoxy)ethyl acetate | 0.035 | 0.035 | 0.035 |
| | ST-4 | 0.0035 | 0.0035 | 0.0035 |
| | Potassium tolylthiosulfonate | 0.003 | 0.003 | 0.003 |
| | Potassium tolylsulfinate | 0.0003 | 0.0003 | 0.0003 |
| | Silver phenylmercaptotetrazole | 0. 0009 | 0.0009 | 0.0009 |
| | Gelatin | 1.356 | 1.356 | 1.356 |

-continued

| LAYER | COMPONENT | AMOUNT (g/m²) Element 201 | Element 202 | Element 203 |
|---|---|---|---|---|
| 4 | UV-1 | 0.033 | 0.033 | 0.033 |
| | UV-2 | 0.188 | 0.188 | 0.188 |
| | ST-4 | 0.097 | 0.097 | 0.097 |
| | Dibutyl phthalate | 0.037 | 0.037 | 0.037 |
| | 1,4-Cyclohexylenedimethylene bis(2-ethylhexanoate) | 0.037 | 0.037 | 0.037 |
| | Gelatin | 0.737 | 0.737 | 0.737 |
| 3 | AG-2 Green sensitive Emulsion | 0.122 (g Ag/m²) | 0.122 (g Ag/m²) | 0.073 (g Ag/m²) |
| | M-7 | | | 0.250 |
| | M-14 | 0.306 | 0.306 | |
| | Dibutyl phthalate | | | 0.089 |
| | Diundecylphthalate | 0.106 | 0.106 | 0.038 |
| | Oleyl alcohol | 0.205 | 0.205 | |
| | ST-16 | 0.084 | 0.084 | 0.190 |
| | ST-7 | | | 0.067 |
| | ST-19 | 0.574 | 0.574 | 0.635 |
| | Phenylmercaptotetrazole | 0.00054 | 0.00054 | 0.00054 |
| | KCl | 0.020 | 0.020 | 0.020 |
| | BIO-1 | 0.00001 | 0.00001 | 0.00001 |
| | Gelatin | 1.06 | 1.06 | 1.420 |
| 2 | ST-4 | 0.108 | 0.108 | 0.108 |
| | Dibutylphthalate | 0.188 | 0.188 | 0.188 |
| | ST-14 | 0.065 | 0.065 | 0.065 |
| | Irganox 1076 ™ | 0.010 | 0.010 | 0.010 |
| | F-1 | 0.002 | 0.002 | 0.002 |
| | 20/80 co-polymer of 2-propenamide and 2-methyl-2-[(1-oxo-2-propenyl)amino]-1-propanesulfonic acid, monosodium salt | 0.573 | 0.573 | 0.573 |
| | Gelatin | 0.753 | 0.753 | 0.753 |
| 1 | AG-1 Blue sensitive Emulsion | 0.218 (g Ag/m²) | 0.218 (g Ag/m²) | 0.218 (g Ag/m²) |
| | Y-11 | 0.484 | 0.484 | 0.484 |
| | N-tert-butylacrylamide/n-butyl acrylate 50/50 copolymer | 0.484 | 0.484 | 0.484 |
| | S-6 | 0.218 | | |
| | I-1 | | 0.218 | |
| | S-5 | | | 0.218 |
| | KCl | 0.020 | 0.020 | 0.020 |
| | Phenylmercaptotetrazole | 0.00013 | 0.00013 | 0.00013 |
| | Piperidino hexose reductone | 0.0023 | 0.0023 | 0.0023 |
| | ST-15 | | | 0.009 |
| | Gelatin | 1.313 | 1.313 | 1.313 |
| Support | Polyethylene laminated paper with $TiO_2$/ZnO in the polyethylene laminated in the first layer side. | | | |

Blue sensitive emulsion AG-1 may be prepared, e.g., in the following manner. A high chloride silver halide emulsion is precipitated by adding approximately equimolar silver nitrate and sodium chloride solutions into a well-stirred reactor containing gelatin peptizer and thioether ripener. $Cs_2Os(NO)Cl_5$ dopant is added during the silver halide grain formation for most of the precipitation, followed by a shelling without dopant. The resultant emulsion contains cubic shaped grains of 0.76 μm in edgelength size. This emulsion is optimally sensitized by the addition of a colloidal suspension of aurous sulfide and heat ramped up to 60° C. during which time a mixture of blue sensitizing dyes BSD-1/BSD-2 (80/20), 1-(3-acetamidophenyl)-5-mercaptotetrazole and potassium bromide are added. In addition, iridium dopant is added during the sensitization process.

Green sensitive emulsion AG-2 may be prepared in the following manner. A high chloride silver halide emulsion is precipitated by adding approximately equimolar silver nitrate and sodium chloride solutions into a well-stirred reactor containing gelatin peptizer and thioether ripener. $Cs_2Os(NO)Cl_5$ dopant is added during the silver halide grain formation for most of the precipitation, followed by a shelling without dopant. The resultant emulsion contains cubic shaped grains of 0.30 μm in edgelength size. This emulsion is optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole.

Red sensitive emulsion AG-3 may be prepared in the following manner. A high chloride silver halide emulsion is precipitated by equimolar addition of silver nitrate and sodium chloride solutions into a well-stirred reactor containing gelatin peptizer and thioether ripener. The resultant emulsion contains cubic shaped grains of 0.40 μm in edgelength size. This emulsion is optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium and ruthenium dopants are added during the sensitization process.

Polyethlene resin coated paper support may be sized as described in U.S. Pat. No. 4,994,147 and pH adjusted as described in U.S. Pat. No. 4,917,994. The polyethylene layer coated on the emulsion side of the support may contain a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers may be hardened with bis(vinylsulfonyl methyl) ether at 1.95% of the total gelatin weight.

Elements 201–203 were tested as in example 1, except that a maximum density value (Dmax) is reported instead of the contrast value y. Samples of these coatings were also incubated for 28 days at 49° C. (120° F.), 50% relative humidity or −17.8° C. (0° F.), 50% relative humidity. The minimum density (density of processed coating where no exposure to light was received) of the latter was subtracted from the former, and reported as A Dmin in the table below.

| Element | Dispersion | Solvent | Dmax | 4 Wk HID @ 1.0 | Δ Dmin |
|---|---|---|---|---|---|
| 201 | 2-1 | S-6 | 2.233 | −0.38 | 0.201 |
| 202 | 2-2 | I-1 | 2.345 | −0.33 | 0.060 |
| 203 | 2-3 | S-5 | 2.242 | −0.41 | 0.035 |

The use of solvent I-1 provides improved Dmax, light stability, and does not exhibit a large increase in Dmin upon incubation.

Following are structures for the compounds referenced above.

BSD-1

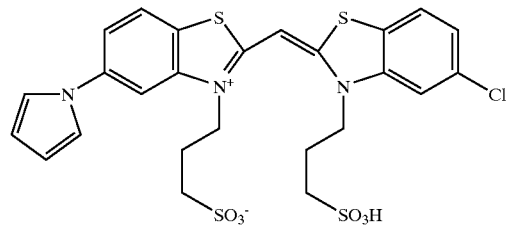

-continued

BSD-2

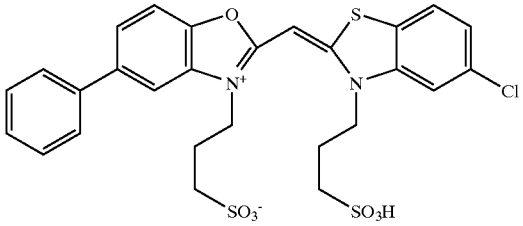

RSD-1

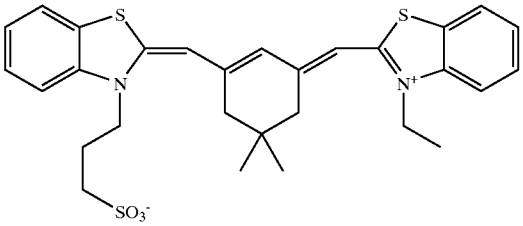

GSD-1

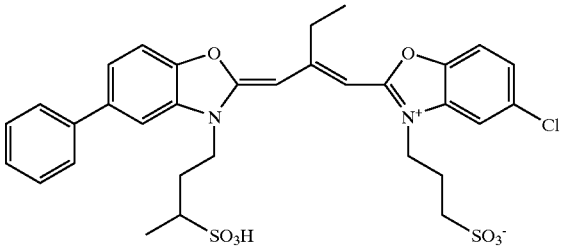

Dye-1

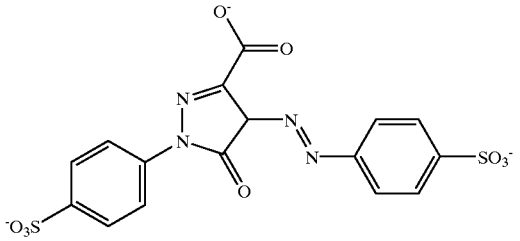

Dye-2

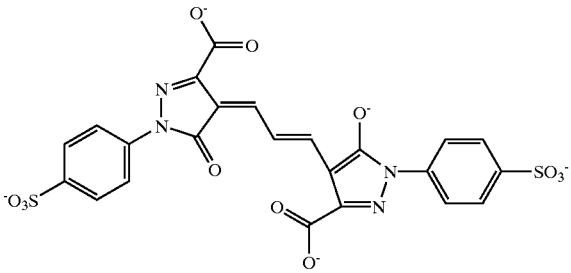

-continued

Dye-3

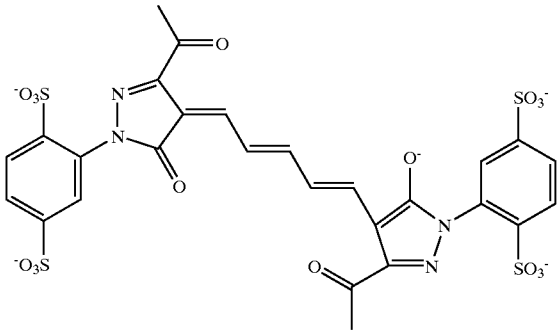

BIO-1

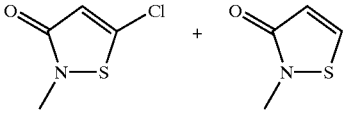

The invention has been described in detail with particular reference to preferred embodiments thereof, but it will be understood that variations and modifications can be effected within the spirit and scope of the invention.

We claim:

1. A silver halide light sensitive photographic element comprising a support bearing at least one yellow image forming hydrophilic colloid layer comprising a yellow dye-forming coupler and a tributyl citrate coupler solvent, wherein the weight ratio of tributyl citrate solvent to yellow coupler in the yellow image forming layer is from 1:5 to 2:1.

2. The element of claim 1 wherein the yellow dye-forming coupler is an acylacetanilide compound.

3. The element of claim 1 wherein the yellow dye-forming coupler is a pivaloylacetanilide compound.

4. The element of claim 1 wherein the yellow dye-forming coupler is a compound of the following formula:

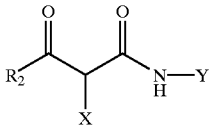

wherein $R_2$ represents a substituent; X is hydrogen or a coupling-off group; and Y represents an aryl group or a heterocyclic group.

5. The element of claim 4 wherein $R_2$ represents an aryl or alkyl group and Y represents an aryl group.

6. The element of claim 5 wherein X represents a nitrogen-containing heterocyclic coupling-off group.

7. The element of claim 6 wherein $R_2$ represents a tertiary alkyl group.

8. The element of claim 4 wherein $R_2$ represents a tertiary alkyl group.

9. A color paper photographic element comprising a reflective support bearing cyan, magenta and yellow dye forming silver halide emulsion hydrophilic colloid layer units sensitized to the red, green and blue regions of the spectrum, wherein the yellow dye forming unit comprises at least one layer hydrophilic colloid layer comprising a yellow dye-forming coupler and a tributyl citrate coupler solvent, wherein the weight ratio of tributyl citrate solvent to yellow coupler in the yellow image forming layer is from 1:5 to 2:1.

10. The element of claim 1, wherein the yellow dye-forming coupler and citrate ester solvent are present in a blue-sensitive silver halide emulsion layer, and further comprising a green light-sensitive silver halide emulsion layer comprising a pyrazolotriazole magenta dye-forming coupler.

* * * * *